US005137651A

United States Patent [19]

Stachura et al.

[11] Patent Number: 5,137,651

[45] Date of Patent: Aug. 11, 1992

[54] AZEOTROPE-LIKE COMPOSITIONS OF 1,1-DICHLORO-1-FLUOROETHANE, DICHLOROTRIFLUOROETHANE, 1,2-DICHLOROETHYLENE, AND OPTIONALLY METHANOL OR ETHANOL

[75] Inventors: Leonard M. Stachura, Hamburg; Ellen L. Swan, Ransomville; Peter B. Logsdon, North Tonawanda; Rajat S. Basu, Williamsville, all of N.Y.

[73] Assignee: Allied-Signal Inc., Morris Township, Morris County, Del.

[21] Appl. No.: 630,131

[22] Filed: Dec. 19, 1990

[51] Int. Cl.[5] ..... C11D 7/30; C11D 7/50; C23G 5/028

[52] U.S. Cl. ..... 252/171; 134/12; 134/31; 134/38; 134/39; 134/40; 252/153; 252/162; 252/170; 252/172; 252/364; 252/DIG. 9

[58] Field of Search ..... 134/12, 31, 38, 39, 134/40; 252/162, 170, 171, 172, 364, DIG. 9, 153

[56] References Cited

U.S. PATENT DOCUMENTS

| | | | |
|---|---|---|---|
| 4,863,630 | 9/1989 | Swan et al. | 252/171 |
| 4,894,176 | 1/1990 | Swan et al. | 252/171 |

FOREIGN PATENT DOCUMENTS

| | | |
|---|---|---|
| 103686 | 4/1989 | Japan . |
| 136981 | 5/1989 | Japan . |
| 136982 | 5/1989 | Japan . |
| 137253 | 5/1989 | Japan . |
| 137259 | 5/1989 | Japan . |
| 138300 | 5/1989 | Japan . |
| 139104 | 5/1989 | Japan . |
| 139861 | 6/1989 | Japan . |

*Primary Examiner*—Paul Lieberman
*Assistant Examiner*—Linda D. Skaling
*Attorney, Agent, or Firm*—Melanie L. Brown; Jay P. Friedenson

[57] ABSTRACT

Azeotrope-like compositions comprising 1,1,-dichloro-1-fluoroethane, dichlorotrifluoroethane, 1,2-dichloroethylene, and optionally ethanol or methanol are stable and have utility as degreasing agents and as solvents in a variety of industrial cleaning applications including cold cleaning and defluxing of printed circuit boards.

15 Claims, No Drawings

AZEOTROPE-LIKE COMPOSITIONS OF 1,1-DICHLORO-1-FLUOROETHANE, DICHLOROTRIFLUOROETHANE, 1,2-DICHLOROETHYLENE, AND OPTIONALLY METHANOL OR ETHANOL

FIELD OF THE INVENTION

This invention relates to azeotrope-like or essentially constant boiling mixtures of 1,1-dichloro-1-fluoroethane, dichlorotrifluoroethane, 1,2-dichloroethylene, and optionally methanol or ethanol. These mixtures are useful in a variety of vapor degreasing, cold cleaning and solvent cleaning applications including defluxing.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not an azeotrope or azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures or azeotrope-like mixtures which offer alternatives for new and special applications for vapor degreasing and other cleaning applications. Currently, of particular interest, are such azeotrope-like mixtures which are based on fluorocarbons which are considered to be stratospherically safe substitutes for presently used fully halogenated chlorofluorocarbons. The latter are suspected of causing environmental problems in connection with the earth's protective ozone layer. Mathematical models have substantiated that hydrochlorofluorocarbons, such as 1,1-dichloro-1-fluoroethane (known in the art as HCFC-141b) and dichlorotrifluoroethane (HCFC-123 or HCFC-123a), will not adversely affect atmospheric chemistry, being negligible contributors to ozone depletion and to green-house global warming in comparison to the fully halogenated species.

Commonly assigned U.S. Pat. No. 4,836,947 discloses azeotrope-like mixtures of 1,1-dichloro-1-fluoroethane and ethanol. Commonly assigned U.S. Pat. No. 4,842,764 discloses azeotrope-like mixtures of 1,1-dichloro-1-fluoroethane and methanol. Commonly assigned U.S. Pat. No. 4,863,630 discloses azeotrope-like mixtures of 1,1-dichloro-1-fluoroethane; dichlorotrifluoroethane; and ethanol. Commonly assigned U.S. Pat. No. 4,894,176 discloses azeotrope-like mixtures of 1,1-dichloro-1-fluoroethane; dichlorotrifluoroethane; and methanol. Commonly assigned U.S. Pat. No. 4,960,535 discloses azeotrope-like mixtures of 1,1-dichloro-1-fluoroethane, dichlorotrifluoroethane, and a mono- or di-chlorinated $C_2$ or $C_3$ alkane. Commonly assigned U.S. Pat. No. 4,965,011 discloses azeotrope-like mixtures of 1,1-dichloro-1-fluoroethane, dichlorotrifluoroethane, and nitromethane.

Kokai Patent Publication 103,686, published Apr. 20, 1989, discloses an azeotropic mixture of 55 to 80 weight percent dichlorotrifluoroethane and 20 to 45 weight percent 1,1-dichloro-1-fluoroethane. Kokai Patent Publication 136,981, published May 30, 1989, discloses a degreasing cleaning agent of an azeotropic mixture of 67 weight percent 1,1-dichloro-2,2,2-trifluoroethane and 33 weight percent 1,1-dichloro-1-fluoroethane, plus hydrocarbons, alcohols, ketones, chlorinated hydrocarbons, and esters.

Kokai Patent Publication 136,982, published May 30, 1989, discloses a buff-grinding cleaning agent of an azeotropic mixture of 67 weight percent 1,1-dichloro- 2,2,2-trifluoroethane and 33 weight percent 1,1-dichloro-1-fluoroethane, plus hydrocarbons, alcohols, ketones, chlorinated hydrocarbons, and esters. Kokai Patent Publication 137,253, published May 30, 1989, discloses a resist developing agent of an azeotropic composition of 67 weight percent 1,1-dichloro-2,2,2-trifluoroethane and 33 weight percent 1,1-dichloro-1-fluoroethane, plus hydrocarbons, alcohols, ketones, chlorinated hydrocarbons, and esters.

Kokai Patent Publication 137,259, published May 30, 1989, discloses a resist separating agent of an azeotropic composition of 67 weight percent 1,1-dichloro-2,2,2-trifluoroethane and 33 weight percent 1,1-dichloro-1-fluoroethane, plus hydrocarbons, alcohols, ketones, chlorinated hydrocarbons, aromatics, and esters. Kokai Patent Publication 138,300, published May 31, 1989, discloses a flux cleaning agent of an azeotrope of 67 weight percent 1,1-dichloro-2,2,2-trifluoroethane and 33 hydrocarbons, alcohols, ketones, and chlorinated hydrocarbons.

Kokai Patent Publication 139,104, published May 31, 1989, discloses a solvent of an azeotropic mixture of 67 weight percent 1,1-dichloro-2,2,2-trifluoroethane and 33 weight percent 1,1-dichloro-1-fluoroethane, plus hydrocarbons, alcohols, ketones, chlorinated hydrocarbons, and surfactants. Kokai Patent Publication 139,861, published Jun. 1, 1989, discloses a dry-cleaning agent of 67 weight percent 1,1-dichloro-2,2,2-trifluoroethane and 33 weight percent 1,1-dichloro-1-fluoroethane, plus hydrocarbons, alcohols, ketones, chlorinated hydrocarbons, and surfactants.

It is an object of this invention to provide novel azeotrope-like compositions based on HCFC-141b and dichlorotrifluoroethane which are liquid at room temperature and which will not fractionate under the process of distillation or evaporation, which are useful as solvents for use in vapor degreasing and other solvent cleaning applications including defluxing applications.

Another object of the invention is to provide novel environmentally acceptable solvents for use in the aforementioned applications.

Other objects and advantages of the invention will become apparent from the following description.

DESCRIPTION OF THE INVENTION

In accordance with the invention, novel azeotrope-like compositions have been discovered comprising 1,1-dichloro-1-fluoroethane; dichlorotrifluoroethane; and 1,2-dichloroethylene. The dichlorotrifluoroethane component can be either of its isomers 1,1-dichloro-2,2,2-trifluoroethane (known in the art as HCFC-123) or 1,2-dichloro-1,2,2-trifluoroethane (known in the art as HCFC-123a), or mixtures thereof in any proportions. The preferred isomer is HCFC-123. The 1,2-dichloroethylene component may be cis-1,2-dichloroethylene; trans-1,2-dichloroethylene; and mixtures thereof in any proportions.

Novel azeotrope-like compositions have also been discovered comprising 1,1-dichloro-1-fluoroethane; dichlorotrifluoroethane; 1,2-dichloroethylene; and methanol or ethanol.

The preferred isomer of dichlorotrifluoroethane is HCFC-123. Preferably, "commercial HCFC-123" which is available as "pure" HCFC-123 containing about 90 to about 95 weight percent of HCFC-123, about 5 to about 10 weight percent of HCFC-123a, and impurities such as trichloromonofluoromethane, trichlorotrifluoroethane, and methylene chloride which due to their presence in insignificant amounts, have no deleterious effects on the properties of the azeotrope-like compositions, is used. "Commercial HCFC-123" is also available as "ultra-pure" HCFC-123 which contains about 95 to about 99.5 weight percent of HCFC-123, about 0.5 to about 5 weight percent of HCFC-123a, and impurities as listed above.

Preferably, the novel azeotrope-like compositions comprise effective amounts of 1,1-dichloro-1-fluoroethane; dichlorotrifluoroethane; and 1,2-dichloroethylene or 1,1-dichloro-1-fluoroethane; dichlorotrifluoroethane; 1,2-dichloroethylene; and methanol or ethanol. The term "effective amounts" as used herein means the amount of each component which upon combination with the other component, results in the formation of the present azeotrope-like composition.

In one embodiment, the azeotrope-like compositions of the invention comprise from about 53 to about 98.99 weight percent of 1,1-dichloro-1-fluoroethane, from about 1 to about 45 weight percent of dichlorotrifluoroethane, and from about 0.01 to about 2 weight percent of 1,2-dichloroethylene.

In a preferred embodiment of the invention, the azeotrope-like compositions of the invention comprise from about 63.5 to about 94.99 weight percent of 1,1-dichloro-1-fluoroethane, from about 5 to about 35 weight percent of dichlorotrifluoroethane, and from about 0.01 to about 1.5 weight percent of 1,2-dichloroethylene.

In the most preferred embodiment of the invention, the azeotrope-like compositions of the invention comprise from about 66 to about 94.99 weight percent of 1,1-dichloro-1-fluoroethane, from about 5 to about 33 weight percent of dichlorotrifluoroethane, and from about 0.01 to about 1 weight percent of 1,2-dichloroethylene which exhibits a boiling point of about 31.9° C.±about 0.5° C. at 760 mm Hg.

Because the boiling point of 1,1-dichloro-2,2,2-trifluoroethane is 27.8° C. and the boiling point of 1,2-dichloro-1,1,2-trifluoroethane is 29.9° C., and the boiling point of trans-1,2-dichloroethylene is 49° C. and the boiling point of cis-1,2-dichloroethylene is 58° C., azeotrope-like compositions of (1) 1,1-dichloro-1-fluoroethane; 1,1-dichloro-2,2,2-trifluoroethane; and trans-1,2-dichloroethylene which exhibit a boiling point of about 31.4° C. at 760 mm Hg (101 kPa); (2) 1,1-dichloro-1-fluoroethane; 1,1-dichloro-2,2,2-trifluoroethane; and cis-1,2-dichloroethylene which exhibit a boiling point of about 32° C. at 760 mm Hg (101 kPa); (3) 1,1-dichloro-1-fluoroethane; 1,1-dichloro-2,2,2-trifluoroethane; and mixtures of trans-1,2-dichloroethylene and cis-1,2-dichloroethylene which exhibit a boiling point of about 31.5° C. at 760 mm Hg (101 kPa); (4) 1,1-dichloro-1-fluoroethane; 1,2-dichloro-1,1,2-trifluoroethane; and trans-1,2-dichloroethylene which exhibit a boiling point of about 31.4° C. at 760 mm Hg (101 kPa); (5) 1,1-dichloro-1-fluoroethane; 1,2-dichloro-1,1,2-trifluoroethane; and cis-1,2-dichloroethylene which exhibit a boiling point of about 32.2° C. at 760 mm Hg (101 kPa); (6) 1,1-dichloro-1-fluoroethane; 1,2-dichloro-1,1,2-trifluoroethane; and mixtures of trans-1,2-dichloroethylene and cis-1,2-dichloroethylene which exhibit a boiling point of about 32° C. at 760 mm Hg (101 kPa); (7) 1,1-dichloro-1-fluoroethane; mixtures of 1,1-dichloro-2,2,2-trifluoroethane and 1,2-dichloro-1,1,2-trifluoroethane; and trans-1,2-dichloroethylene which exhibit a boiling point of about 32° C. at 760 mm Hg (101 kPa); (8) 1,1-dichloro-1-fluoroethane; mixtures of 1,1-dichloro-2,2,2-trifluoroethane and 1,2-dichloro-1,1,2-trifluoroethane; and cis-1,2-dichloroethylene which exhibit a boiling point of about 32.2° C. at 760 mm Hg (101 kPa); or (9) 1,1-dichloro-1-fluoroethane; mixtures of 1,1-dichloro-2,2,2-trifluoroethane and 1,2-dichloro-1,1,2-trifluoroethane; and mixtures of trans-1,2-dichloroethylene and cis-1,2-dichloroethylene which exhibit a boiling point of about 32.3° C. at 760 mm Hg (101 kPa) form in the same weight percent proportions as set forth above in the three preceding paragraphs.

In one embodiment, the azeotrope-like compositions of the invention comprise from about 47.0 to about 98.9 weight percent of 1,1-dichloro-1-fluoroethane, from about 1.0 to about 45.0 weight percent of dichlorotrifluoroethane, from about 0.1 to about 5.0 weight percent of 1,2-dichloroethylene, and up to about 3.0 weight percent ethanol.

In a preferred embodiment of the invention, the azeotrope-like compositions of the invention comprise from about 59.5 to about 94.9 weight percent of 1,1-dichloro-1-fluoroethane, from about 5.0 to about 35.0 weight percent of dichlorotrifluoroethane, from about 0.1 to about 3.0 weight percent of 1,2-dichloroethylene, and up to about 2.5 weight percent ethanol.

In the most preferred embodiment of the invention, the azeotrope-like compositions of the invention comprise from about 62.5 to about 94.5 weight percent of 1,1-dichloro-1-fluoroethane, from about 5.0 to about 33.0 weight percent of dichlorotrifluoroethane, from about 0.5 to about 2.5 weight percent of 1,2-dichloroethylene, and from about 0.5 to about 2.0 weight percent ethanol which exhibits a boiling point of about 31.4° C.±about 0.7° C. at 760 mm Hg.

Because the boiling point of 1,1-dichloro-2,2,2-trifluoroethane is 27.8° C. and the boiling point of 1,2-dichloro-1,1,2-trifluoroethane is 29.9° C., and the boiling point of trans-1,2-dichloroethylene is 49° C. and the boiling point of cis-1,2-dichloroethylene is 58° C., azeotrope-like compositions of (1) 1,1-dichloro-1-fluoroethane; 1,1-dichloro-2,2,2-trifluoroethane; trans-1,2-dichloroethylene; and ethanol which exhibit a boiling point of about 31.4° C. at 760 mm Hg (101 kPa); (2) 1,1-dichloro-1-fluoroethane; 1,1-dichloro-2,2,2-trifluoroethane; cis-1,2-dichloroethylene; and ethanol which exhibit a boiling point of about 31.4° C. at 760 mm Hg (101 kPa); (3) 1,1-dichloro-1-fluoroethane; 1,1-dichloro-2,2,2-trifluoroethane; mixtures of trans-1,2-dichloroethylene and cis-1,2-dichloroethylene; and ethanol which exhibit a boiling point of about 31.4° C. at 760 mm Hg (101 kPa); (4) 1,1-dichloro-1-fluoroethane; 1,2-dichloro-1,1,2-trifluoroethane; trans-1,2-dichloroethylene; and ethanol which exhibit a boiling point of about 31.4° C. at 760 mm Hg (101 kPa); (5) 1,1-dichloro-1-fluoroethane; 1,2-dichloro-1,1,2-trifluoroethane; cis-1,2-dichloroethylene; and ethanol which exhibit a boiling point of about 31.4° C. at 760 mm Hg (101 kPa); (6) 1,1-dichloro-1-fluoroethane; 1,2-dichloro-1,1,2-trifluoroethane; mixtures of trans-1,2-dichloroethylene and cis-1,2-dichloroethylene; and ethanol which exhibit a boiling point of about 31.4° C. at 760 mm Hg (101 kPa); (7) 1,1-dichloro-1-fluoroethane; mixtures of 1,1-dichloro-2,2,2-trifluoroethane and 1,2-dichloro-1,1,2-trifluoroethane; trans-1,2-dichloroethylene; and ethanol which exhibit a boiling point of about 31.4° C. at 760 mm Hg (101 kPa); (8) 1,1-dichloro-1-fluoroethane; mixtures of 1,1-dichloro-2,2,2-trifluoroethane and 1,2-dichloro-1,1,2-trifluoroethane; cis-1,2-dichloroethylene; and ethanol which exhibit a boiling point of about 31.4° C. at 760 mm Hg (101 kPa); or (9) 1,1-dichloro-1-fluoroethane; mixtures of 1,1-dichloro-2,2,2-trifluoroethane and 1,2-dichloro-1,1,2-trifluoroethane; mixtures of trans-1,2-dichloroethylene and cis-1,2-dichloroethylene; and ethanol which exhibit a boiling point of about 31.4° C. at 760 mm Hg (101 kPa) form in the same weight percent proportions as set forth above in the three preceding paragraphs.

In another embodiment, the azeotrope-like compositions of the invention comprise from about 45.0 to about 98.9 weight percent of 1,1-dichloro-1-fluoroethane, from about 1.0 to about 45.0 weight percent of dichlorotrifluoroethane, from about 0.1 to about 5.0 weight percent 1,2-dichloroethylene, and up to about 5.0 weight percent of methanol.

In a preferred embodiment of the invention, the constant-boiling compositions of the invention comprise from about 58.0 to about 94.9 weight percent of 1,1-dichloro-1-fluoroethane, from about 5.0 to about 35.0 weight percent of dichlorotrifluoroethane, from about 0.1 to about 3.0 weight percent 1,2-dichloroethylene, and up to about 4.0 weight percent of methanol.

In the most preferred embodiment of the invention, the constant-boiling compositions of the invention comprise from about 60.2 to about 91.5 weight percent 1,1-dichloro-1-fluoroethane, about 5.0 to about 33.0 weight percent dichlorotrifluoroethane, about 0.5 to about 3.0 weight percent 1,2-dichloroethylene, and about 3.0 to about 3.8 weight percent methanol which exhibits a boiling point of about 30.3° C.±about 0.7° C. at 760 mm Hg.

Because the boiling point of 1,1-dichloro-2,2,2-trifluoroethane is 27.8° C. and the boiling point of 1,2-dichloro-1,1,2-trifluoroethane is 29.9° C., and the boiling point of trans-1,2-dichloroethylene is 49° C. and the boiling point of cis-1,2-dichloroethylene is 58° C., azeotrope-like compositions of (1) 1,1-dichloro-1-fluoroethane; 1,1-dichloro-2,2,2-trifluoroethane; trans-1,2-dichloroethylene; and methanol which exhibit a boiling point of about 30.3° C. at 760 mm Hg (101 kPa); (2) 1,1-dichloro-1-fluoroethane; 1,1-dichloro-2,2,2-trifluoroethane; cis-1,2-dichloroethylene; and methanol which exhibit a boiling point of about 30.3° C. at 760 mm Hg (101 kPa); (3) 1,1-dichloro-1-fluoroethane; 1,1-dichloro-2,2,2-trifluoroethane; mixtures of trans-1,2-dichloroethylene and cis-1,2-dichloroethylene; and methanol which exhibit a boiling point of about 30.3° C. at 760 mm Hg (101 kPa); (4) 1,1-dichloro-1-fluoroethane; 1,2-dichloro-1,1,2-trifluoroethane; trans-1,2-dichloroethylene; and methanol which exhibit a boiling point of about 30.3° C. at 760 mm Hg (101 kPa); (5) 1,1-dichloro-1-fluoroethane; 1,2-dichloro-1,1,2-trifluoroethane; cis-1,2-dichloroethylene; and methanol which exhibit a boiling point of about 30.3° C. at 760 mm Hg (101 kPa); (6) 1,1-dichloro-1-fluoroethane; 1,2-dichloro-1,1,2-trifluoroethane; mixtures of trans-1,2-dichloroethylene and cis-1,2-dichloroethylene; and methanol which exhibit a boiling point of about 30.3° C. at 760 mm Hg (101 kPa); (7) 1,1-dichloro-1-fluoroethane; mixtures of 1,1-dichloro-2,2,2-trifluoroethane and 1,2-dichloro-1,1,2-trifluoroethane; trans-1,2-dichloroethylene; and methanol which exhibit a boiling point of about 30.3° C. at 760 mm Hg (101 kPa); (8) 1,1-dichloro-1-fluoroethane; mixtures of 1,1-dichloro-2,2,2-trifluoroethane and 1,2-dichloro-1,1,2-trifluoroethane; cis-1,2-dichloroethylene; and methanol which exhibit a boiling point of about 30.3° C. at 760 mm Hg (101 kPa); or (9) 1,1-dichloro-1-fluoroethane; mixtures of 1,1-dichloro-2,2,2-trifluoroethane and 1,2-dichloro-1,1,2-trifluoroethane; mixtures of trans-1,2-dichloroethylene and cis-1,2-dichloroethylene; and methanol which exhibit a boiling point of about 30.3° C. at 760 mm Hg (101 kPa) form in the same weight percent proportions as set forth above in the three preceding paragraphs.

The azeotrope-like compositions of the invention containing a mixture of HCFC-123 and HCFC-123a behave as an azeotrope-like composition because the separate quaternary azeotropic compositions with HCFC-123 and HCFC-123a have boiling points so close to one another as to be indistinguishable for practical purposes.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method—ASTM D 1310-86.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution—number of plates) which would be expected to separate the mixture into its separate components. If the mixture is non-azeotropic or non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate. It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly as does the boiling point of the composition. Thus, an azeotrope of A and B represents a unique type of relationship but with a variable composition depending on temperature and/or pressure. As is readily understood by persons skilled in the art, the boiling point of the azeotrope will vary with the pressure.

In the process embodiment of the invention, the azeotrope-like compositions of the invention may be used to clean solid surfaces by treating the surfaces with the compositions in any manner well known to the art such as by dipping or spraying or use of conventional degreasing apparatus.

The 1,1-dichloro-1-fluoroethane; dichlorotrifluoroethane; trans-1,2-dichloroethylene; cis-1,2-dichloroethylene; methanol; and ethanol components of the novel solvent azeotrope-like compositions of the invention are known materials. Commercially available cis-1,2-dichloroethylene and trans-1,2-dichloroethylene may be used in the present invention. It should be noted that commercially available cis-1,2-dichloroethylene may also contain trans-1,2-dichloroethylene; also, commercially available trans-1,2-dichloroethylene may also contain cis-1,2-dichloroethylene. Preferably the present components should be used in sufficiently high purity so as to avoid the introduction of adverse influences upon the solvency properties or constant boiling properties of the system.

For example, cis-1,2-dichloroethylene may consist of a mixture of cis-1,2-dichloroethylene together with trans-1,2-dichloroethylene wherein trans-1,2-dichloroethylene is present in the mixture in an amount from about 0.1 to about 25 weight percent. Trans-1,2-dichloroethylene may also be present in the mixture in an amount from about 0.1 to about 10 weight percent. Trans-1,2-dichloroethylene may also be present in the mixture in an amount from about 0.1 to about 5 weight percent.

Also, for example, trans-1,2-dichloroethylene may consist of a mixture of trans-1,2-dichloroethylene together with cis-1,2-dichloroethylene wherein cis-1,2-dichloroethylene is present in the mixture in an amount from about 0.1 to about 25 weight percent. Cis-1,2-dichloroethylene may also be present in the mixture in an amount from about 0.1 to about 10 weight percent. Cis-1,2-dichloroethylene may also be present in the mixture in an amount from about 0.1 to about 5 weight percent.

It should be understood that the present compositions may include additional components so as to form new azeotrope-like compositions. Any such compositions are considered to be within the scope of the present invention as long as the compositions are constant-boiling or essentially constant-boiling and contain all of the essential components described herein.

The present azeotrope-like compositions are useful as solvents for use in vapor degreasing and other solvent cleaning applications including defluxing, cold cleaning, dry cleaning, dewatering, decontamination, spot cleaning, aerosol propelled rework, extraction, particle removal, and surfactant cleaning applications. These azeotrope-like compositions are also useful as blowing agents, rankine cycle and absorption refrigerants, and power fluids.

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art.

Examples of useful alkanols having 4 to 7 carbon atoms are 2-methyl-2-propanol; 2-methyl-2-butanol; 1-pentanol; 2-pentanol; 3-pentanol; and 3-ethyl-3-pentanol. The preferred alkanols are 2-methyl-2-propanol and 3-pentanol.

Examples of useful nitroalkanes having 1 to 3 carbon atoms include nitromethane, nitroethane, 1-nitropropane, and 2-nitropropane. The preferred nitroalkanes are nitromethane and nitroethane.

Examples of useful 1,2-epoxyalkanes having 2 to 7 carbon atoms include epoxyethane; 1,2-epoxypropane; 1,2-epoxybutane; 2,3-epoxybutane; 1,2-epoxypentane; 2,3-epoxypentane; 1,2-epoxyhexane; and 1,2-epoxyheptane. The preferred 1,2-epoxyalkanes are 1,2-epoxybutane and 1,2-epoxypropane.

Examples of useful phosphite esters having 12 to 30 carbon atoms include diphenyl phosphite; triphenyl phosphite; triisodecyl phosphite; triisooctyl phosphite; and diisooctyl phosphite. The preferred phosphite esters are triisodecyl phosphite (hereinafter TDP) and triisooctyl phosphite (hereinafter TOP).

Examples of useful ethers having 3 or 4 carbon atoms include diethylene oxide; 1,2-butylene oxide; 2,3-butylene oxide; and dimethoxymethane. The preferred ethers are diethylene oxide and dimethoxymethane.

Examples of useful unsaturated compounds having 4 to 6 carbon atoms include 1,4-butyne diol; 1,5-pentyne diol; and 1,6-hexyne diol. The preferred unsaturated compounds are 1,4-butyne diol and 1,5-pentyne diol.

Examples of useful acetals having 4 to 7 carbon atoms include dimethoxyethane; 1,1-diethyoxyethane; and dipropoxymethane. The preferred acetals are dimethoxyethane and dipropoxymethane.

Examples of useful ketones having 3 to 5 carbon atoms include 2-propanone; 2-butanone; and 3-pentanone. The preferred ketones are 2-propanone and 2-butanone.

Examples of useful amines having 6 to 8 carbon atoms include triethyl amine, dipropyl amine, and diisobutyl amine. The preferred amines are triethyl amine and dipropyl amine.

The inhibitors may be used alone or in mixtures thereof in any proportions. Typically, up to about 2 percent based on the total weight of the azeotrope-like composition of inhibitor might be used.

The present invention is more fully illustrated by the following non-limiting Examples.

EXAMPLES 1-4

These examples confirm the existence of azeotrope-like mixtures between (1) 1,1-dichloro-1-fluoroethane; 1,1-dichloro-2,2,2-trifluoroethane; and trans-1,2-dichloroethylene; (2) 1,1-dichloro-1-fluoroethane; 1,1-dichloro-2,2,2-trifluoroethane; trans-1,2-dichloroethylene; and ethanol; and (3) 1,1-dichloro-1-fluoroethane; 1,1-dichloro-2,2,2-trifluoroethane; trans-1,2-dichloroethylene; and methanol via the method of distillation. These examples also illustrate that these mixtures do not fractionate during distillation.

A 5-plate Oldershaw distillation column with a cold water condensed automatic liquid dividing head was used for these examples. For each Example, the distillation column was charged with as indicated in Table 1 below which was heated under total reflux for about an hour to ensure equilibration. A reflux ratio of 8:1 was employed for this particular distillation. Approximately 50 percent of the original charges were collected in four similar-sized overhead fractions. The compositions of these fractions were analyzed using gas chromatography. Table I shows the compositions of the starting materials. The averages of the distillate fractions and the overhead temperatures are quite constant within the uncertainty associated with determining the compositions, indicating that the mixtures are constant boiling or azeotrope-like. In Table 1, T-DCE stands for trans-1,2-dichloroethylene, EtOH stands for ethanol, and MeOH stands for methanol.

TABLE I

| Example | HCFC-141b | HCFC-123 | T-DCE | EtOH | MeOH |
|---|---|---|---|---|---|
| | Starting Material (WT. %) | | | | |
| 1 | 74.0 | 25.0 | 1.0 | — | — |
| 2 | 86.4 | 10.1 | 1.6 | 1.9 | — |
| 3 | 71.3 | 25.6 | 2.0 | 1.1 | — |
| 4 | 85.0 | 10.0 | 2.0 | — | 3.0 |
| | Distillate Fractions (WT. %) | | | | |
| 1 | 71.7 | 27.8 | 0.5 | — | — |
| 2 | 86.2 | 11.4 | 1.0 | 1.4 | — |
| 3 | 70.0 | 28.2 | 1.1 | 0.7 | — |
| 4 | 85.7 | 9.8 | 0.8 | — | 3.7 |

| Example | Boiling Point (°C.) | Barometric Pressure (mm Hg) | Boiling Point (°C.) Corrected to 760 mmHg (101 kpa) |
|---|---|---|---|
| 1 | 30.9 | 747.2 (99 kPa) | 31.4 |
| 2 | 30.2 | 754.2 (101 kPa) | 30.7 |
| 3 | 31.5 | 754.5 (101 kPa) | 32.0 |
| 4 | 29.9 | 749 (100 kPa) | 30.3 |

EXAMPLES 5-28

The following compositions are made. C-DCE stands for cis-1,2-dichloroethylene and T-DCE stands for trans-1,2-dichloroethylene.

| Example | Composition |
|---|---|
| 5 | HCFC-141b/HCFC-123/C-DCE |
| 6 | HCFC-141b/HCFC-123/(C-DCE, T-DCE) |
| 7 | HCFC-141b/HCFC-123a/T-DCE |
| 8 | HCFC-141b/HCFC-123a/C-DCE |
| 9 | HCFC-141b/HCFC-123a/(C-DCE, T-DCE) |
| 10 | HCFC-141b/(HCFC-123, HCFC-123a)/T-DCE |
| 11 | HCFC-141b/(HCFC-123, HCFC-123a)/C-DCE |
| 12 | HCFC-141b/(HCFC-123, HCFC-123a)/(C-DCE, T-DCE) |
| 13 | HCFC-141b/HCFC-123/C-DCE/EtOH |
| 14 | HCFC-141b/HCFC-123/(C-DCE, T-DCE)/EtOH |
| 15 | HCFC-141b/HCFC-123a/T-DCE/EtOH |
| 16 | HCFC-141b/HCFC-123a/C-DCE/EtOH |
| 17 | HCFC-141b/HCFC-123a/(T-DCE, C-DCE)/EtOH |
| 18 | HCFC-141b/(HCFC-123, HCFC-123a)/T-DCE/EtOH |
| 19 | HCFC-141b/(HCFC-123, HCFC-123a)/C-DCE/EtOH |
| 20 | HCFC-141b/(HCFC-123, HCFC-123a)/(T-DCE, C-DCE/EtOH |

-continued

| Example | Composition |
|---|---|
| 21 | HCFC-141b/HCFC-123/C-DCE/MeOH |
| 22 | HCFC-141b/HCFC-123/(T-DCE, C-DCE)/MeOH |
| 23 | HCFC-141b/HCFC-123a/T-DCE/MeOH |
| 24 | HCFC-141b/HCFC-123a/C-DCE/MeOH |
| 25 | HCFC-141b/HCFC-123a/(T-DCE, C-DCE)/MeOH |
| 26 | HCFC-141b/(HCFC-123, HCFC-123a)/ T-DCE/MeOH |
| 27 | HCFC-141b/(HCFC-123, HCFC-123a)/ C-DCE/MeOH |
| 28 | HCFC-141b/(HCFC-123, HCFC-123a)/(T-DCE, C-DCE)/MeOH |

EXAMPLES 29-56

Performance studies are conducted wherein metal coupons are cleaned using the present azeotrope-like compositions as solvents. The metal coupons are soiled with various types of oils and heated to 93° C. so as to partially simulate the temperature attained while machining and grinding in the presence of these oils.

The metal coupons thus treated are degreased in a three-sump vapor phase degreaser machine. In this typical three-sump degreaser, condenser coils around the lip of the machine are used to condense the solvent vapor which is then collected in a sump. The condensate overflows into cascading sumps and eventually goes into the boiling sump.

The metal coupons are held in the solvent vapor and then vapor rinsed for a period of 15 seconds to 2 minutes depending upon the oils selected. The azeotrope-like compositions of Examples 1 through 28 are used as the solvents. Cleanliness testing of coupons are done by measurement of the weight change of the coupons using an analytical balance to determine the total residual materials left after cleaning.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 53 to about 98.99 weight percent 1,1-dichloro-1-fluoroethane, from about 1 to about 45 weight percent 1,1-dichloro-2,2,2-trifluoroethane, and from about 0.01 to about 2 weight percent trans-1,2-dichloroethylene which boil at about 31.9° C.±760 mm Hg.

2. The azeotrope-like compositions of claim 1 consisting essentially of from about 63.5 to about 94.99 weight percent said 1,1-dichloro-1-fluoroethane, from about 5 to about 35 weight percent said 1,1-dichloro-2,2,2-trifluoroethane, and from about 0.01 to about 1.5 weight percent said trans-1,2-dichloroethylene.

3. The azeotrope-like compositions of claim 1 consisting essentially of from about 66 to about 94.99 weight percent said 1,1-dichloro-1-fluoroethane, from about 5 to about 33 weight percent said 1,1-dichloro-2,2,2-trifluoroethane, and from about 0.01 to abut 1 weight percent said trans-1,2-dichloroethylene.

4. Azeotrope-like compositions consisting essentially of from about 47.0 to about 98.9 weight percent of 1,1-dichloro-1-fluoroethane, from about 1.0 to about 45.0 weight percent of 1,1-dichloro-2,2,2-trifluoroethane, from about 0.1 to about 5.0 weight percent of trans-1,2-dichloroethylene, and from about 0.5 to about 3.0 weight percent ethanol which boil at about 31.4° C.±0.7° C. at 760 mm Hg.

5. The azeotrope-like compositions of claim 4 consisting essentially of from about 59.5 to about 94.9 weight percent of said 1,1-dichloro-1-fluoroethane, from about 5.0 to about 35.0 weight percent of said 1,1-dichloro-2,2,2-trifluoroethane, from about 0.1 to about 3.0 weight percent of said trans-1,2-dichloroethylene, and from about 0.5 to about 2.5 weight percent said ethanol.

6. The azeotrope-like compositions of claim 4 consisting essentially of from about 62.5 to about 94.5 weight percent of said 1,1-dichloro-1-fluoroethane, from about 5.0 to about 33.0 weight percent of said 1,1-dichloro-2,2,2-trifluoroethane, from about 0.5 to about 2.5 weight percent of said trans-1,2-dichloroethylene, and from about 0.5 to about 2.0 weight percent said ethanol.

7. Azeotrope-like compositions consisting essentially of from about 45.0 to about 98.9 weight percent of 1,1-dichloro-1-fluoroethane, from about 1.0 to about 45.0 weight percent of 1,1-dichloro-2,2,2-trifluoroethane, from about 0. 1 to about 5.0 weight percent trans-1,2-dichloroethylene, and from about 3.0 to about 5.0 weight percent of methanol which boil at about 30.0° C.±0.7° C. at 760 mm Hg.

8. The azeotrope-like compositions of claim 7 consisting essentially of from about 58.0 to about 94.9 weight percent of said 1,1-dichloro-1-fluoroethane, from about 5.0 to abut 35.0 weight percent of said 1,1-dichloro-2,2,2-trifluoroethane, from about 0.1 to about 3.0 weight percent said trans-1,2-dichloroethylene, and from about 3.0 to about 4.0 weight percent of said methanol.

9. The azeotrope-like compositions of claim 7 consisting essentially of from about 60.2 to about 91.5 weight percent said 1,1-dichloro-1-fluoroethane, form about 5.0 to abut 33.0 weight percent said 1,1-dichloro-2,2,2-trifluoroethane, from about 0.1 to about 3.0 weight percent said trans 1,2-dichloroethylene, and about 3.0 to about 3.8 weight percent said methanol.

10. The azeotrope-like compositions of claim 1 wherein said compositions additionally contain an effective amount of an inhibitor which inhibits decomposition of said azeotrope-like compositions, reacts with undesirable decomposition products of said azeotrope-like compositions, or prevents corrosion of metal surfaces selected from the group consisting of alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 to 4 carbon atoms, unsaturated compounds having 4 to 6 carbon atoms, acetals having 4 to 7 carbon atoms, ketones having 3 to 5 carbon atoms, and amines having 6 to 8 carbon atoms.

11. The azeotrope-like compositions of claim 4 wherein said compositions additionally contain an effective amount of an inhibitor which inhibits decomposition of said azeotrope-like compositions, reacts with undesirable decomposition products of said azeotrope-like compositions, or prevents corrosion of metal surface selected from the group consisting of alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms and amines having 6 to 8 carbon atoms.

12. The azeotrope-like compositions of claim 7 wherein said compositions additionally contain an effective amount of an inhibitor which inhibits decomposition of said azeotrope-like compositions, reacts with undesirable decomposition products of said azeotrope-like compositions, or prevents corrosion of meal surfaces selected from the group consisting of alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms.

13. A method of cleaning a solid surface which comprises treating said surface with said azeotrope-like composition as defined in claim 1.

14. A method of cleaning a solid surface which comprises treating said surface with said azeotrope-like composition as defined in claim 4.

15. A method of cleaning a solid surface which comprises treating said surface with said azeotrope-like composition as defined in claim 7.

* * * * *

UNITED STATES PATENT AND TRADEMARK OFFICE

CERTIFICATE OF CORRECTION

PATENT NO. : 5,137,651

DATED : August 11, 1992

INVENTOR(S) : Leonard M. Stachura, Ellen L. Swan, Peter B. Logsdon and Rajat S. Basu It is certified that error appears in the above-identified patent and that said Letters Patent is hereby corrected as shown below:

Col. 11, line 49, "31.9°C ± 760 mm" should read -- 31.9°C ± 0.5°C at --.

Col. 11, line 61, " to abut 1 weight " should read -- to about 1 weight --.

Col. 12, line 34, "form about 5.0" should read -- from about 5.0--.

Col. 12, line 28, "5.0 to abut 35.0" should read -- 5.0 to about 35.0 --.

Col. 12, line 35, "to abut 33.0" should read -- to about 33 0 --.

Signed and Sealed this

Ninth Day of November, 1993

Bruce Lehman

*Attest:*

BRUCE LEHMAN

*Attesting Officer*

*Commissioner of Patents and Trademarks*